US011167396B1

(12) United States Patent
Rotem et al.

(10) Patent No.: US 11,167,396 B1
(45) Date of Patent: Nov. 9, 2021

(54) SELF-HOLDING AND SELF-DRIVING DRILLING SYSTEM

(71) Applicant: Nemo Power Tools Ltd, Sheung Wan (HK)

(72) Inventors: Nimrod Rotem, Sheung Wan (HK); Oleg Joukov, Shaar Efraim (IL); Eduard Tsfasman, Shaar Efraim (IL); Gan Yufan, Shenzhen (CN)

(73) Assignee: Nemo Power Tools Ltd., Sheung Wan (HK)

( * ) Notice: Subject to any disclaimer, the term of this patent is extended or adjusted under 35 U.S.C. 154(b) by 0 days.

(21) Appl. No.: 17/365,236

(22) Filed: Jul. 1, 2021

(51) Int. Cl.
*B25B 11/00* (2006.01)
*B25F 5/02* (2006.01)

(52) U.S. Cl.
CPC ..... *B25B 11/007* (2013.01); *B25F 5/02* (2013.01)

(58) Field of Classification Search
CPC ..... B25B 11/007; B25F 5/02
See application file for complete search history.

(56) References Cited

U.S. PATENT DOCUMENTS 3,240,525 A * 3/1966 Wood ..... B65G 49/061 294/185
3,506,297 A * 4/1970 Creskoff ..... B66C 1/0281 294/65
3,640,562 A * 2/1972 Creskoff ..... B66C 1/0281 294/65
D340,256 S * 10/1993 Ng ..... 101/163
5,681,022 A * 10/1997 Rankin ..... F16B 47/00 248/205.9

FOREIGN PATENT DOCUMENTS

GB 1036586 A * 7/1966 ..... B65G 47/91

* cited by examiner

*Primary Examiner* — Stephen A Vu
(74) *Attorney, Agent, or Firm* — Intellent Patents LLC; Ahmed Alhafidh

(57) ABSTRACT

A self-holding drilling system utilizes a vacuum gripping base and an air extraction pump to apply a holding force toward an object surface while maintaining surface-ward pressure on a drilling apparatus mounted therein. The pump extracts air from two discrete, but coupled volumes: a volume associated with the vacuum gripping base and a volume related to one or more piston tubes mounted transversely to the vacuum gripping element and movably coupled to the drilling apparatus. The surface area of the piston tubes is less than the surface area of the vacuum gripping base, which ensures the holding force is sufficient to prevent the drilling system from lifting from the object surface while also ensuring a driving force on the drilling apparatus is always less than the holding force. Thus, the operation of the drilling apparatus automatically drills into an object surface without requiring manual pressure on the drilling apparatus.

5 Claims, 7 Drawing Sheets

SELF-HOLDING AND SELF-DRIVING DRILLING SYSTEM

FIELD OF TECHNOLOGY

This disclosure relates generally to drilling apparatuses and, more particularly, to a drilling apparatus which continuously holds itself against an object surface while applying a driving force to drill holes therethrough.

BACKGROUND

A drill is a mechanical apparatus used to drive attached interchangeable drill bits into an object surface and produce a hole. A drill operator must apply a holding force on the drill toward the object surface and drive the tip of the drill bit against the object surface. This force must be consistently applied and adjusted as the drill bit's typically helical contours bore through the surface. However, manual drill operation is a tedious and physical arduous task which can quickly fatigue an operator, especially without proper ergonomics.

Self-holding devices, such as vacuum grippers described in U.S. Patent Publication No. 2020/0338695 (hereinafter '695), chiefly comprise a rigid base element and a loop-shaped vacuum seal element attached thereto. A vacuum generated between an object surface and the base element, but within the confines of the seal element, forces the vacuum gripper against the object surface. Although these devices work well to hold themselves against different object surfaces, they alone are unable to account for opposing forces between the drill and the surface, which can push the vacuum gripper away from the object surface. For example, a drill effectively pushes itself away from an object as it operates, so a holding force that emulates a human operator must adjust pressure accordingly while still applying a driving force on the drill against the object surface. A feedback mechanism may be utilized which can sense these forces and continuously adjust actuators that apply the holding force to prevent a drill from pushing itself away, but this mechanism would be prohibitively costly and may not ensure safe operation if, for example, a sensor or actuator fails. Furthermore, since vacuum gripper performance can vary when used across object surfaces of different materials, the issue of autonomously maintaining a reliable holding force on a drill is compounded.

Thus, there exists a need for a self-holding, self-driving drilling system that provides reliable, fail-proof, autonomous operation regardless of the type of object surface drilled.

SUMMARY

Disclosed is a self-holding and self-driving drill system which incorporates a vacuum gripper base which has a drilling aperture, a sealing element, and an air extraction means. The sealing element comprises a peripheral seal which is disposed within an outer channel of the vacuum gripper base and an inner seal disposed within an inner channel around the drilling aperture. The activity of the air extraction means creates a low-pressure environment in a first volume contained by the sealing element, the vacuum gripper base, and an object surface. A delta pressure between the first volume and the immediate environment generates a holding force which causes the sealing element to conform to the object surface when the vacuum gripper base is pressed thereagainst.

The drilling system also incorporates a drilling assembly coupled to the vacuum gripper base. The drilling assembly comprises a drill apparatus positioned transverse to the drilling aperture. One or more piston tube(s) are transversely mounted to the vacuum gripper base in alignment with the housing. A linear pneumatic operation of the piston tube(s) causes the drill apparatus to move in a vertical direction with respect to the vacuum gripper base. One or more apertures in the base allow the first volume to be in fluid contact with a second volume contained by the piston tube(s).

The holding force is proportional to a first surface area of the first volume and effectively holds the self-drilling system to the object surface. Furthermore, a driving force is exerted upon the drilling apparatus by a low-pressure environment in the second volume. The driving force is equal to an opposing force exerted upon the drilling apparatus by the object surface during regular operation and is proportional to a second surface area of the second volume. The holding force is always greater than the driving force because the first surface area is greater than the second surface area, thus causing the drilling apparatus to be urged into the object surface without lifting the vacuum gripper base from the object surface no compromising the sealing element.

BRIEF DESCRIPTION OF THE DRAWINGS

The embodiments of this invention are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

Figure 1:
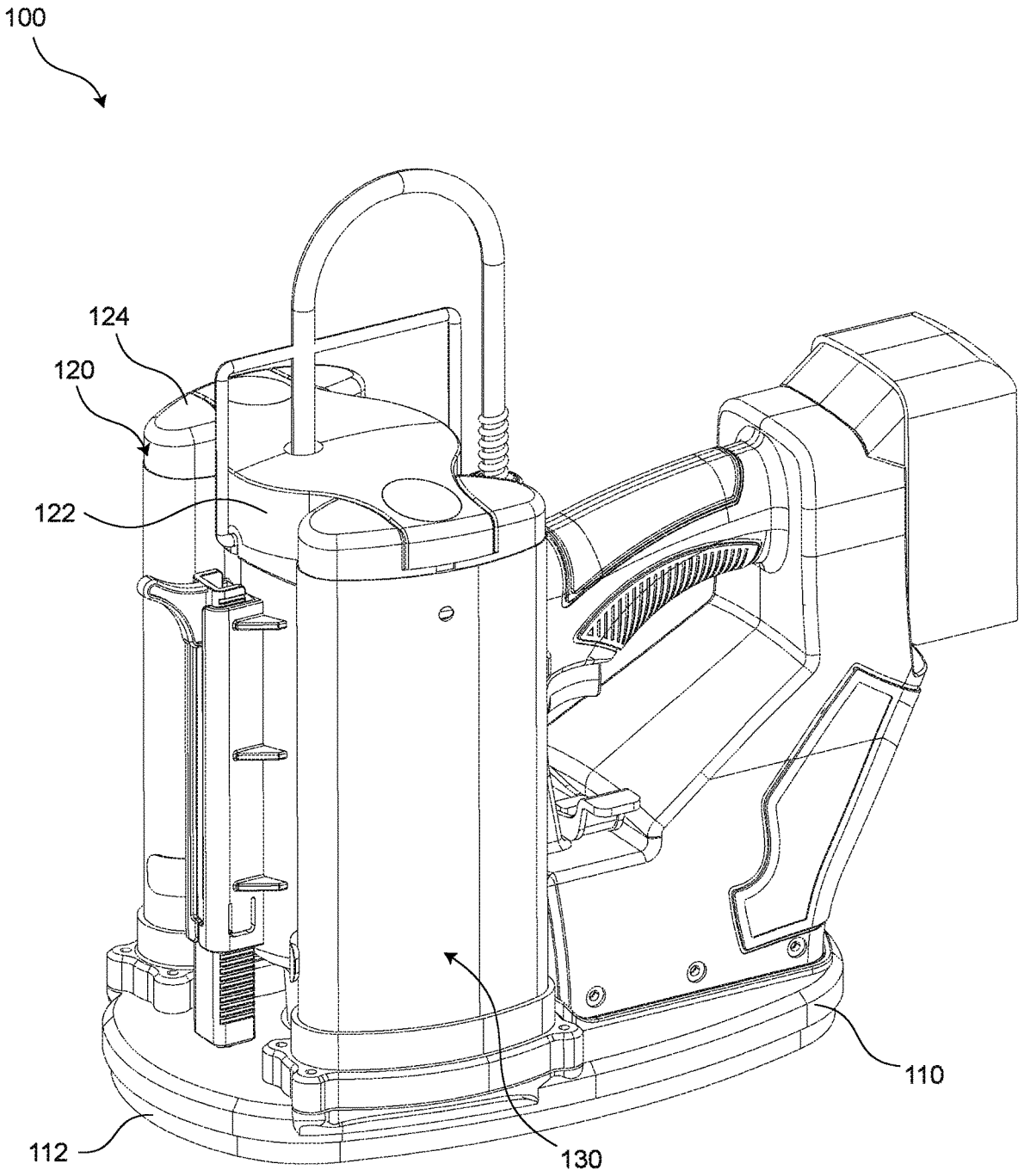
FIG. 1 is a perspective view of an exemplary self-holding drilling system, according to one or more embodiments.

Example embodiments, as described below, may be used to provide a self-holding drilling system. As used herein, 'self-holding' not only refers to the use of current vacuum gripper technology as described in U.S. Patent Publication No. 2020/0338695 (hereinafter '695), but also to the capacity of the drilling system described herein to urge a drilling apparatus thereof against an object surface without lifting the entire system off the object surface. Referring to FIG. 1, an exemplary self-holding drilling system 100 (hereinafter 'drilling system 100') is illustrated. The drilling system 100 comprises a vacuum gripper base 110 and a drilling assembly 120 coupled thereto.

Figure 2:
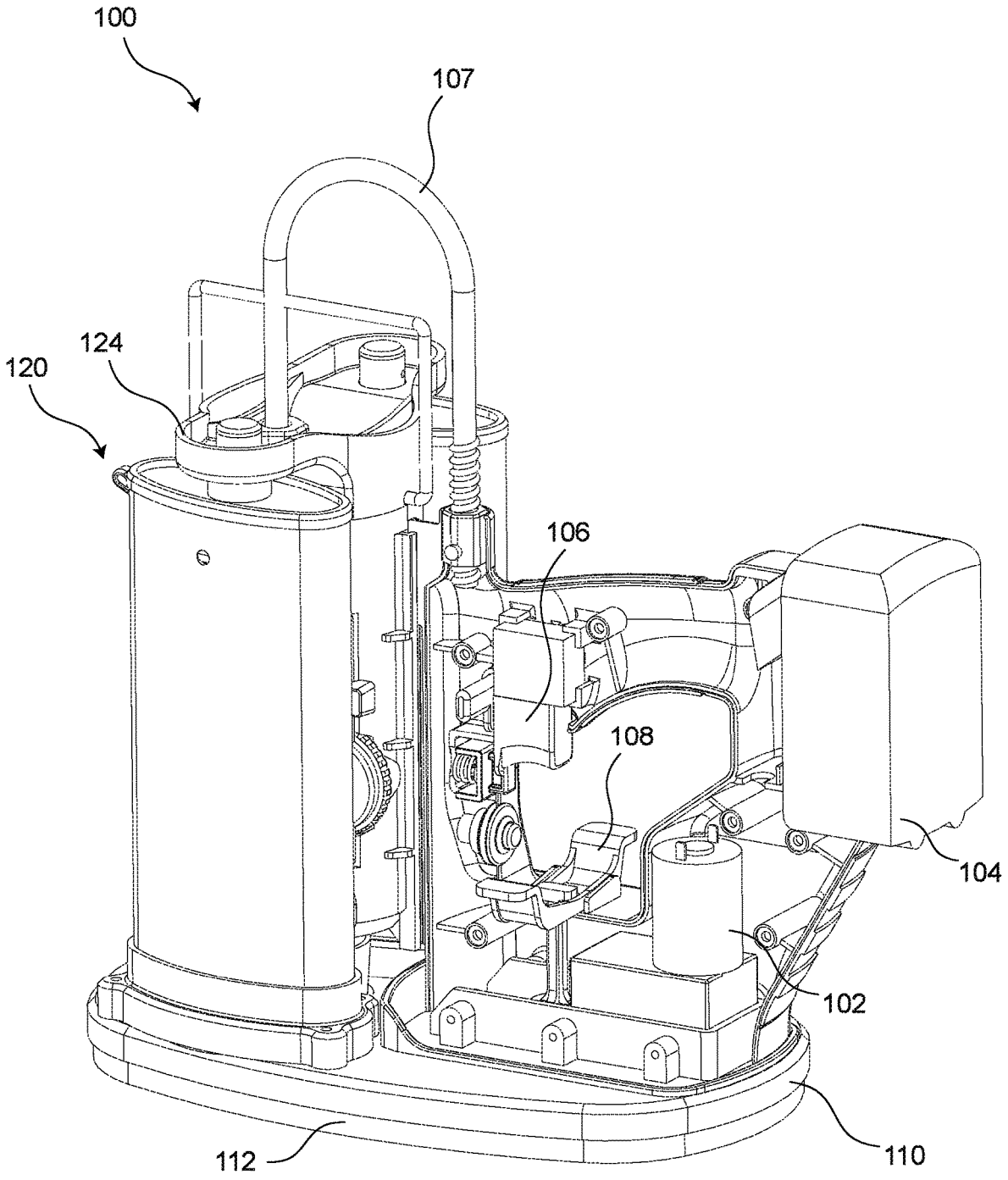
FIG. 2 is a perspective view of the self-holding drilling system illustrating interior components.

The vacuum gripper base 110 may be similar to the rigid base element of '695 (See marker 141 of FIG. 8 of '695), i.e., it incorporates a sealing element 112 which conforms to an object surface when the vacuum gripper base 110 is pressed thereagainst. Referring to FIG. 2, a cutaway shows internal components of the drilling system 100, including but not limited to: an air pump 102 which extracts air from the vacuum gripper base 110; a battery 104 which portably powers the electronic components of the drilling system 100; a trigger 106 providing power controls to a user of the drilling system 100; a flexible cable cover 107 which insulates communicative couplings between the drilling assembly 120 and the other internal components of the drilling system 100; a release valve 108 which, when manipulated, releases the drilling system 100 from an object surface by equalizing the pressure between the internal volume of the drilling system 100 and that of the ambient space. Although the drilling system 100 is shown to be powered by a portal battery 104, it should be understood that the drilling system 100 may be adapted to received power from an A/C power source through a coupled power cord.

Figure 3A:
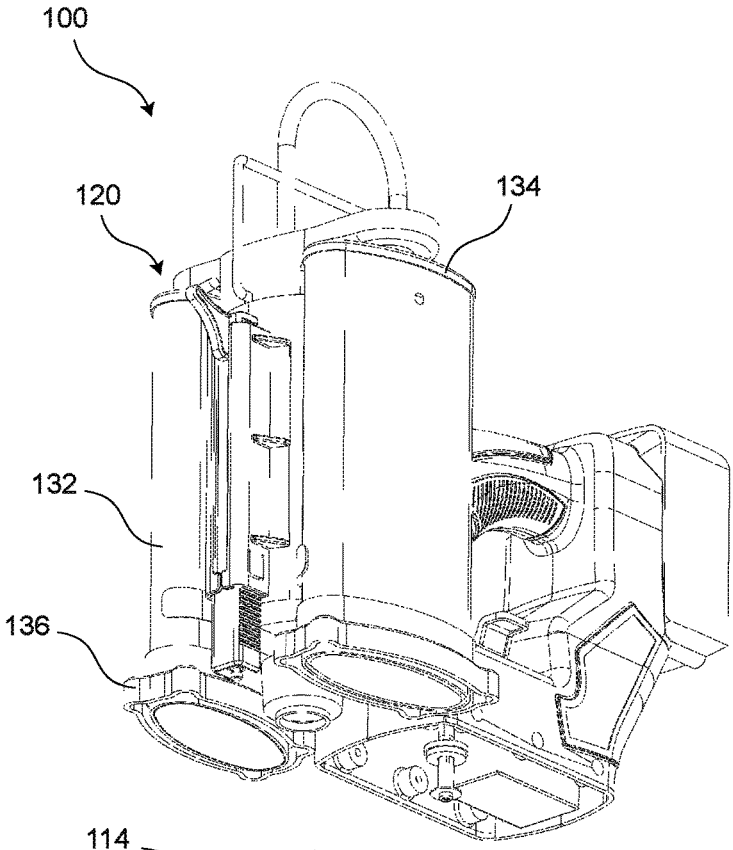
FIG. 3A is a partial exploded view of the self-holding drilling system, showing assembly of a vacuum gripper base and sealing element.
Figure 3A:
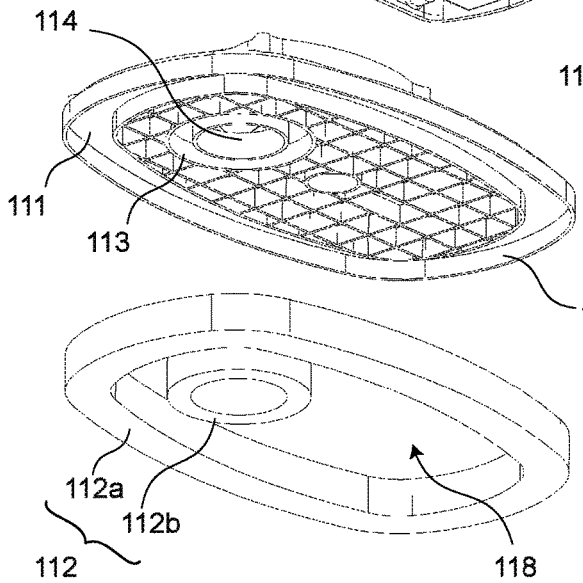

Referring to FIG. 3A, a partial exploded view of the drilling system 100 shows assembly of the vacuum gripper base 110 and sealing element 112. Additionally, referring to FIG. 3B, a top perspective view of the vacuum gripper base is shown. The vacuum gripper base 110 comprises a peripheral outer channel 111 defined by an outer wall, an inner wall, and a receiving surface. Additionally, the vacuum gripper base 110 may comprise an inner channel 113 similarly defined but positioned around a drilling aperture 114 through which a drill bit (not shown) of the drilling apparatus may extend. The sealing element 112 is composed of two parts: a peripheral seal 112*a* which fits the peripheral outer channel 111 and an inner seal 112*g* which fits the inner channel 113. The sealing element 112 may be made of a collapsible material, such as foam, that deforms locally and is directed by the walls of the outer channel 111 and the inner channel 113 against an object surface to create an air-tight seal.

In one embodiment, the air pump 102 provides a suctioning force that collects debris and other waste created by the drill apparatus. The suctioning force may remove debris through and/or around the drilling aperture 114 and direct the debris to a localized storage area.

Figure 7:
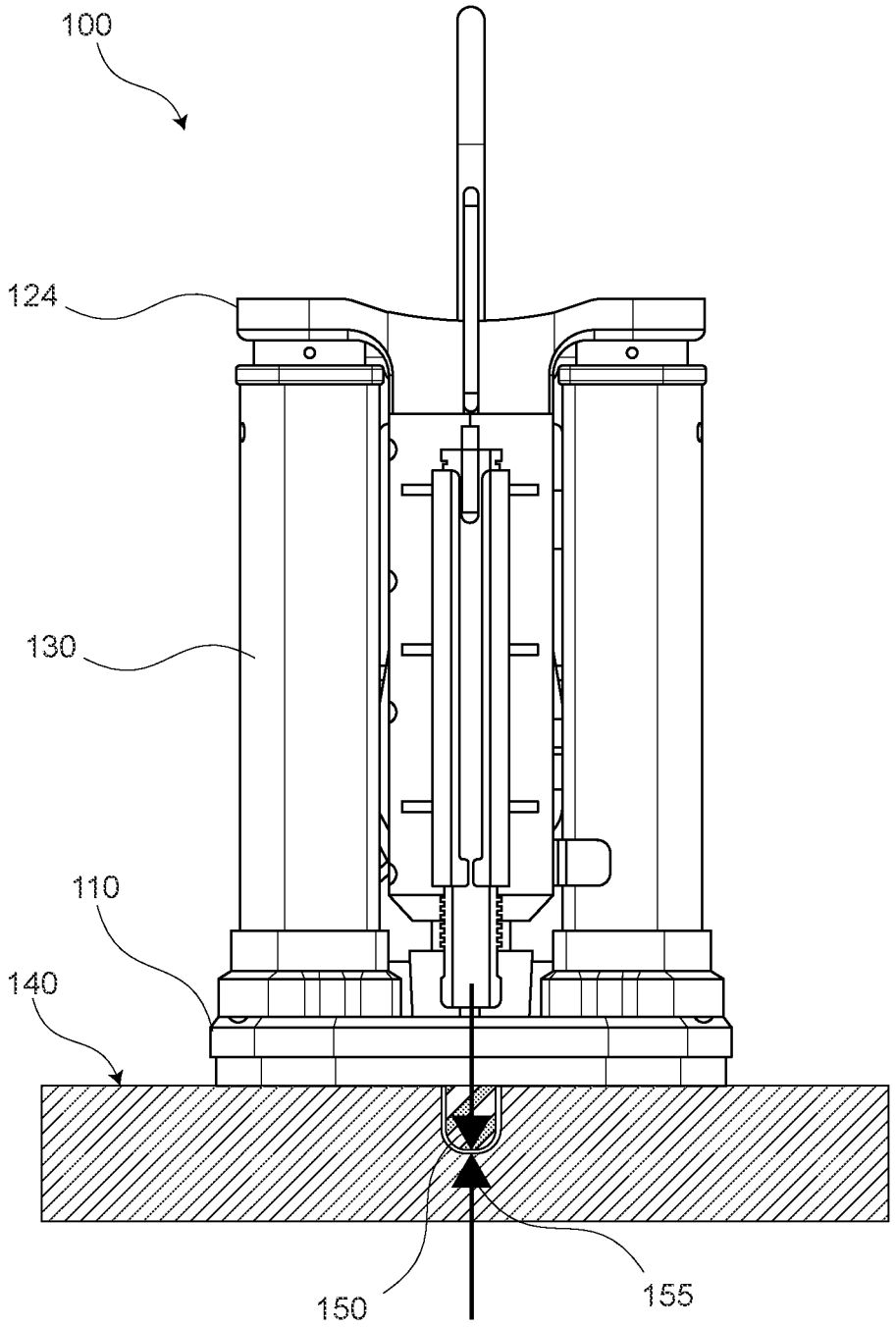
FIG. 7 is a front elevation view of the self-holding drilling system applied against an object surface.

Referring to FIG. 7, a front elevation view of the drilling system 100 is shown. As shown, the drilling system 100 is pressed against an object surface 140. Provided a sufficient driving force 150, a drill bit 121 coupled to the drilling apparatus may bore into the object surface 140. However, an opposing force 155 equaling the driving force 150 pushes against the drill bit 121 and therefore the entire drilling system 100. Therefore, it is vital that this driving force 150 does not exceed a holding force 160 which the vacuum gripper base 110 exerts upon the drilling system 100 to keep it held against the object surface 140.

Figure 6:
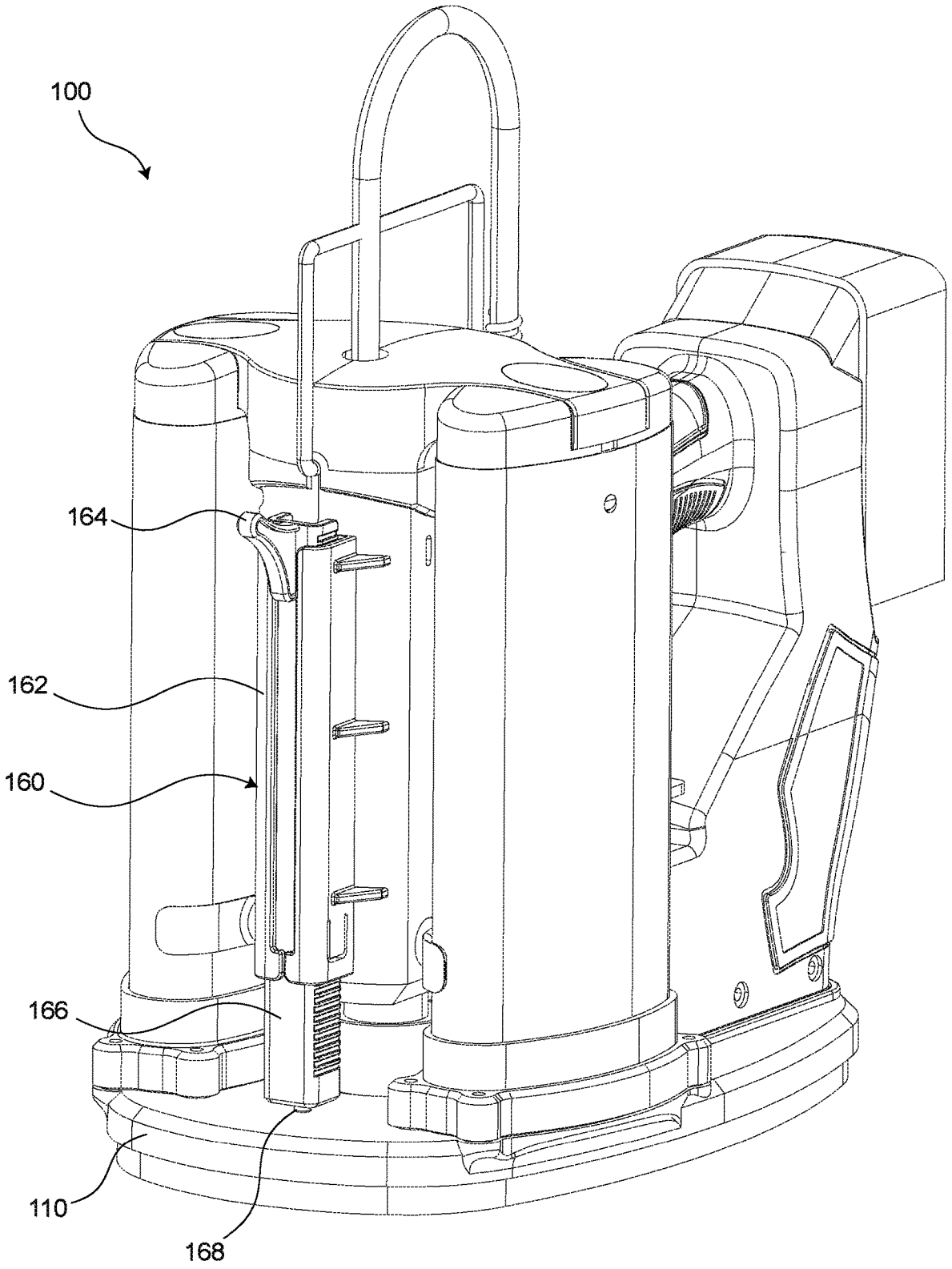
FIG. 6 is a front perspective view of the self-holding drilling system showing a distance limiting element.

Referring to FIG. 6, a front perspective view of the drilling system 100 shows a distance limiter 160 which halts the operation of the drilling system 100 once the drilling system has reached a lower vertical limit. The distance limiter 160 may comprise a distance limiting rod 166 slidably positioned within a limiter housing 162. The distance limiting rod 166 may comprise grooves on its sides, allowing the distance limiting rod 166 to be moved vertically and fixed in a vertical position. The limiter housing 162 may comprise protrusions that complement the grooves of the distance limiting rod 166. On an end of the distance limiting rod 166 facing the upper surface of the vacuum gripper base 110, the distance limiting rod 166 may comprise a push-button tip 168 that is operationally tied to the drilling apparatus, i.e., when the push-button tip is pressed, the drilling apparatus halts operation. This does not, however, halt the operation of the air pump, which prevents the drilling system 100 from removing itself from an object surface after finishing drilling.

The operation of the air pump 102 serves to extract air from a volume 118 that is contained by the vacuum gripper base 110, the sealing element 112, and an object surface (not shown). As a result of the low-pressure environment of volume 118, the vacuum gripper base 110 and the object surface exert a holding force 160 and an equal opposing force 165 upon one another that is proportional to the surface area of the volume 118. It is important to note that the surface area of the vacuum gripper base 110 is maximized by the use of a suction pad as shown which incorporates a grid-like structure.

Figure 4:
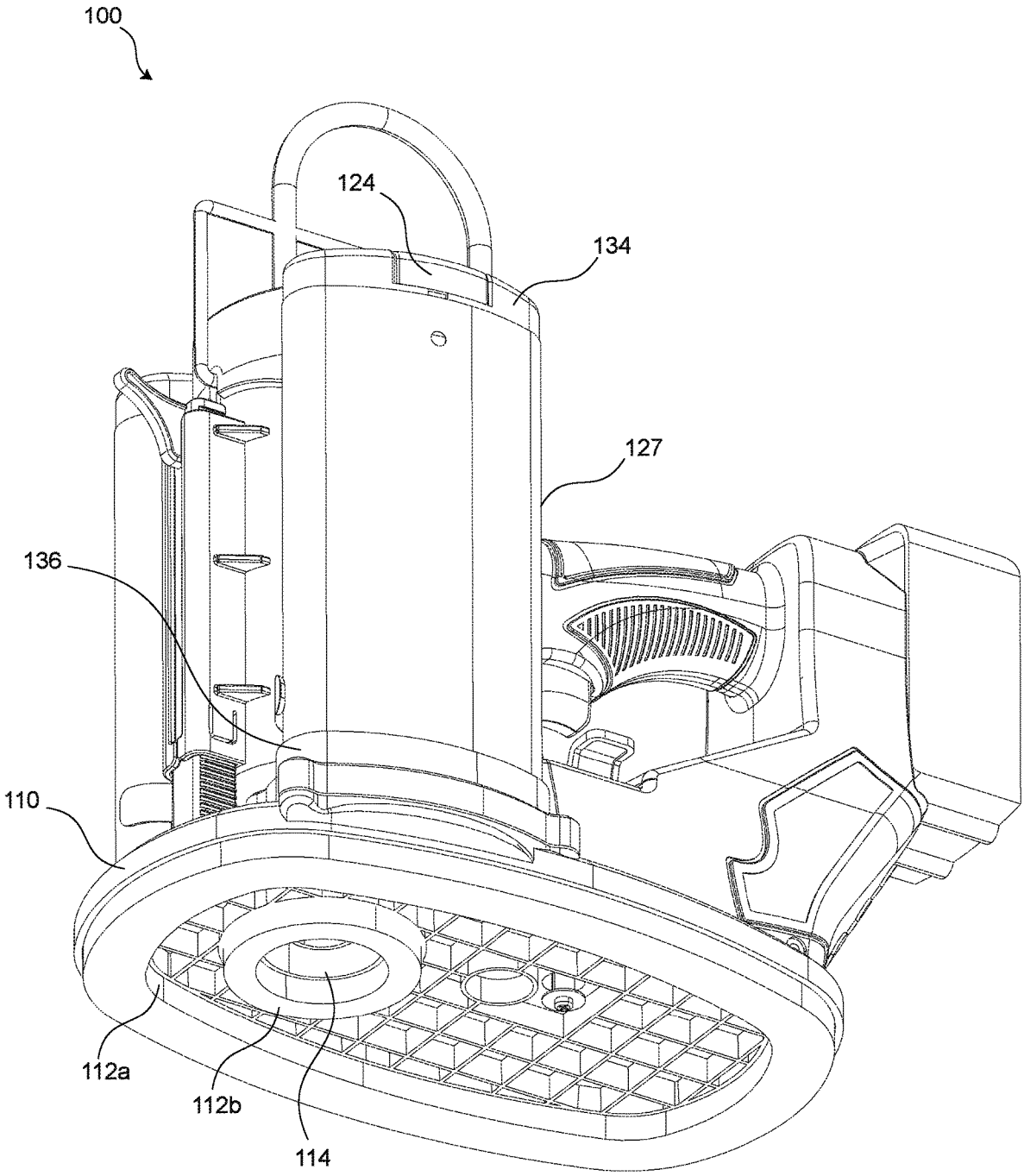
FIG. 4 is a bottom perspective view of the self-holding drilling system.
Figures 5A, 5B:
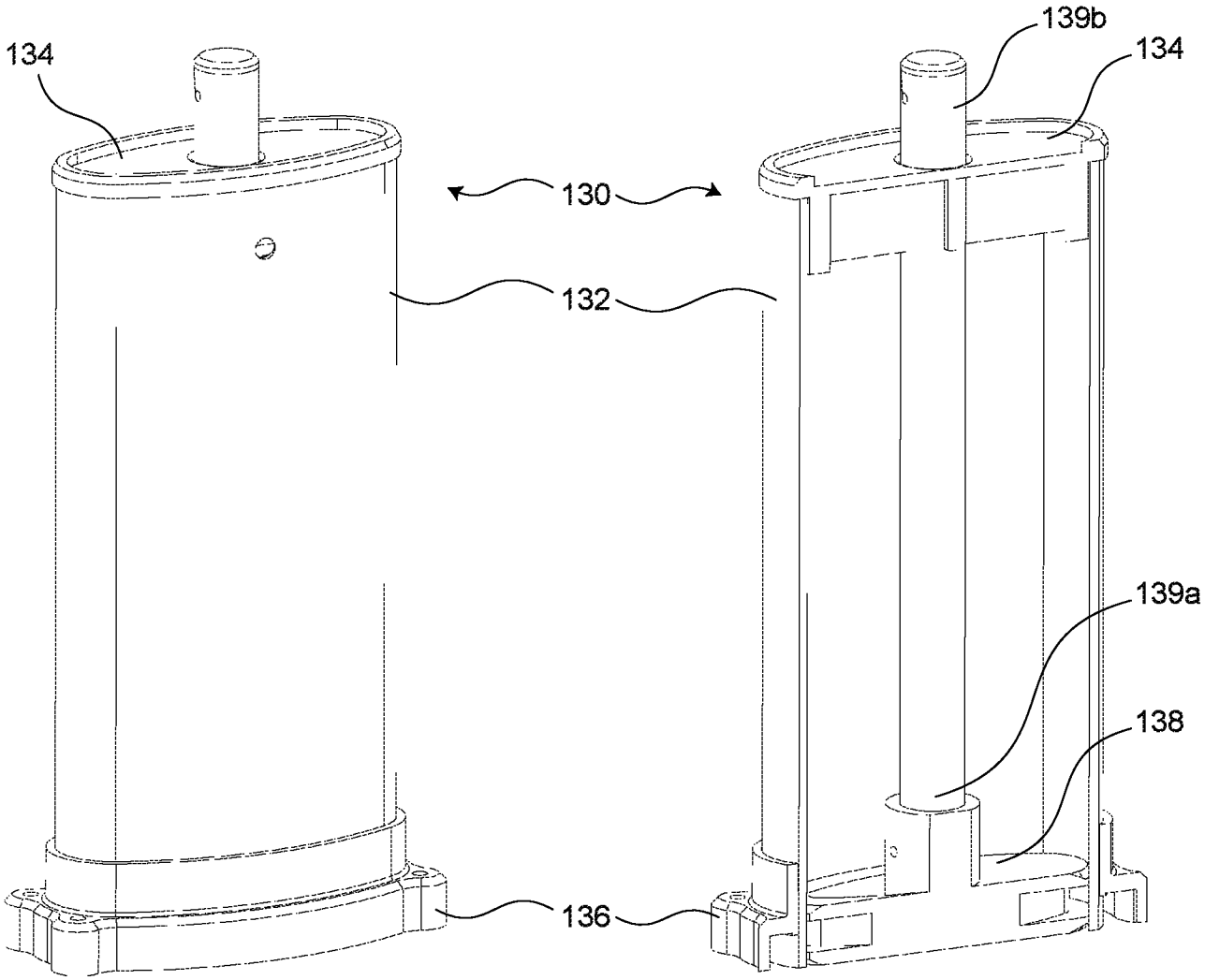
FIG. 5A is a perspective view of a piston tube and FIG. 5B is a cross-section view of the same.

The drilling assembly 120 comprises a housing 122 having sidewalls encompassing a drilling apparatus (not shown). The drilling apparatus accepts the typical variety of bits of various form factors, materials, and is centrally mounted over the drilling aperture 114. A downward force of the drilling apparatus would push the housing 122 upwards. The top of the housing 122 sidewalls incorporates a piston collar 124 which hold one or more piston tubes 130 against the vacuum gripper base 110. The piston tubes 130 are transversely mounted to the vacuum gripper base 110 and align vertically with the housing 122. Referring to FIG. 4, a bottom perspective view of the drilling system 100 shows the structure of the piston tube 130 and positioning relative to the vacuum gripper base 110. Additionally, referring to FIGS. 5A and 5B, a perspective view and a cross-section view are shown, respectively. The piston tube 130 comprises an annular sidewall 132, a cap 134, a base 136 coupled to the vacuum gripper base 110, piston 138 housed within the annular sidewall 132, and a shaft 139 transversely coupled to the piston 138 on a first end 139*a* and coupled to the piston collar 124 on a second end 139*b* thereof. The piston 138 is slidable within the annular sidewall 132 and the shaft 139 is slidable through the cap 134.

Figure 3B:
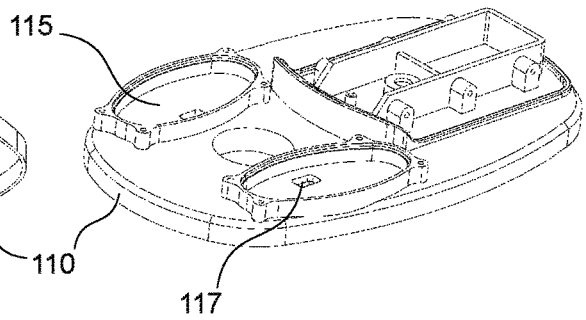
FIG. 3B is a top perspective view of the vacuum gripper base.

Referring back to FIG. 7 and also to FIG. 3B, the piston tube mount 115 as shown comprises an equalization aperture 117 which provides an open interface between the volume 118 and a volume 119 contained by the annular sidewall 132, the piston 138, and the base 136. An outward force F within a defined volume is characterized by the pressure differential ΔP between the volume and the ambient environment 170 multiplied by the surface area A of the volume, as shown:

$$F=\Delta P*A \quad \text{(Eq. 1).}$$

A low-pressure environment in the volume 119 causes the piston tubes 130 to exert a driving force 150 ($F_D$) upon the drilling apparatus and subsequently upon the object surface 140. $F_D$ is equal to an opposing force 155 ($F_D'$) exerted upon the drilling apparatus by the object surface 140 during regular operation.

$$F_D=F_D' \quad \text{(Eq. 2)}$$

Based on Equation 1 above, driving force $F_D$ is proportional to the pressure differential (ΔP) between the volume 119 and the immediate environment 170 and the surface area $A_1$ of the volume 119, as shown:

$$F_D=\Delta P*A_1 \quad \text{(Eq. 3)}$$

The volume 119 shares the same pressure differential of the volume 118. The ΔP between the volume 118 and the immediate environment causes the vacuum gripping base 110 to exert a holding force $F_H$ on the drilling system 100 against the object surface 140. Analogously to $F_D$, $F_H$ is proportional to the ΔP between the volume 119 and the immediate environment 170 multiplied by the surface area $A_2$ of the volume 119, as shown:

$$F_H = \Delta P * A_2 \quad \text{(Eq. 4)}$$

Since the surface area of the volume 119 ($A_2$) is always significantly less than the surface area of the volume 118 ($A_1$), $F_H$ is always greater than $F_D$, which causes the drilling system 100 to remain held against the object surface 140 while maintaining an $F_D$ on the drilling apparatus that does not exceed the holding force $F_H$, thus preventing the drilling system from lifting itself from the object surface 140.

All references including patents, patent applications and publications cited herein are incorporated herein by reference in their entirety and for all purposes to the same extent as if each individual publication or patent or patent application was specifically and individually indicated to be incorporated by reference in its entirety for all purposes.

What is claimed is:

1. A self-holding drilling system, comprising:

a vacuum gripper base comprising a drilling aperture, a sealing element, and an air extraction means, wherein the sealing element comprises a peripheral seal disposed within an outer channel of the vacuum gripper base and an inner seal disposed within an inner channel around the drilling aperture, wherein a holding force causes the sealing element to conform to an object surface when the vacuum gripper base is pressed thereagainst during regular operation due to a pressure differential created by the air extraction means between an immediate environment and a first volume contained by: the sealing element, the vacuum gripper base, and the object surface;

a drilling assembly coupled to the vacuum gripper base, comprising:

a drill apparatus positioned transverse to the drilling aperture;

one or more piston tube(s) transversely mounted to the vacuum gripper base in alignment with the drill apparatus, wherein a linear pneumatic operation of each piston tube moves the drill apparatus in a vertical direction with respect to the vacuum gripper base;

wherein the piston tube(s) contain a second volume which shares the pressure differential of the first volume;

wherein the holding force is proportional to a first surface area of the first volume and the delta pressure between the first volume and the immediate environment, wherein the holding force effectively holds the self-holding drilling system to the object surface;

wherein a driving force exerted upon the drilling apparatus is equal to an opposing force exerted upon the drilling apparatus by the object surface during regular operation and is proportional to a second surface area of the second volume and the delta pressure between the second volume and the immediate environment;

wherein the holding force is greater than the driving force because the first surface area is greater than the second surface area, allowing the drilling apparatus to be urged into the object surface without lifting the vacuum gripper base from the object surface nor compromising the sealing element.

2. The system of claim 1, wherein the drilling assembly further comprises:

a distance limiting rod slidably contained within a groove of the drilling assembly longitudinally aligned with the drilling assembly; and a push-button tip coupled to an end of the distance limiting rod proximal to the vacuum gripper base, wherein the push button tip is communicatively coupled to the drill apparatus and when the push button tip contacts an upper surface of the vacuum gripper base, the drill apparatus halts operation.

3. The system of claim 1, further comprising:

a release lever configured to lift an airlock from a release aperture of the vacuum gripper base, allowing manual reversal of the low-pressure environments in the first volume and the second volume.

4. The system of claim 1, wherein the air extraction means provides a suctioning force that removes debris through the drilling aperture and deposits the debris in a localized storage.

5. The system of claim 1, further comprising a power source, wherein the power source is an attached battery or an adapted A/C power source.

* * * * *